US011291338B2

(12) United States Patent
Wexler et al.

(10) Patent No.: US 11,291,338 B2
(45) **Date of Patent: *Apr. 5, 2022**

(54) WIPE DISPENSER AND RELATED METHODS

(71) Applicant: Medline Industries, LP, Northfield, IL (US)

(72) Inventors: Paige Wexler, Highland Park, IL (US); Michael Turturro, Arlington Heights, IL (US); Megan Henken, Wauconda, IL (US)

(73) Assignee: Medline Industries, LP, Northfield, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/714,371

(22) Filed: Dec. 13, 2019

(65) Prior Publication Data

US 2020/0205623 A1 Jul. 2, 2020

Related U.S. Application Data

(63) Continuation of application No. 16/234,915, filed on Dec. 28, 2018, now Pat. No. 10,694,903.

(51) Int. Cl.
*A47K 10/42* (2006.01)
*A47K 10/32* (2006.01)

(52) U.S. Cl.
CPC .... *A47K 10/421* (2013.01); *A47K 2010/3266* (2013.01)

(58) Field of Classification Search
CPC ..... A47K 10/185; A47K 10/22; A47K 10/38; A47K 2010/3233; A47K 2010/3266
(Continued)

(56) References Cited

U.S. PATENT DOCUMENTS 2,338,604 A 1/1944 Silveyra
3,252,632 A 5/1966 Hagenes
(Continued)

FOREIGN PATENT DOCUMENTS

EP 0502751 A2 9/1992
EP 0748748 A1 12/1996
(Continued)

OTHER PUBLICATIONS

Jamar, San, "Kleen Keeper Wet Wipe Dispenser," https://youtu.be/Ky_TYjply4A, published May 8, 2018.
(Continued)

*Primary Examiner* — Gene O Crawford
*Assistant Examiner* — Ayodeji T Ojofeitimi
(74) *Attorney, Agent, or Firm* — Fitch, Even, Tabin & Flannery LLP

(57) ABSTRACT

A wipe dispenser and related methods are disclosed herein. In one form, a wall mounted wipe dispensing system is disclosed comprising a wall mount support bracket, a dispensing bag of wipes having a rigid collar from which to suspend the dispensing bag from the wall mount support bracket, and wherein the wall mount support bracket and dispensing bag have first mating structures for mating the dispensing bag to the wall mount support bracket. In other forms, a wall mounted support bracket is disclosed and/or replaceable wipe packaging is disclosed. In still other forms methods related to these are also disclosed.

11 Claims, 14 Drawing Sheets

(58) Field of Classification Search
USPC ..... 221/33–63
See application file for complete search history.

(56) References Cited

U.S. PATENT DOCUMENTS

| | | | |
|---|---|---|---|
| 3,986,479 | A | 10/1976 | Bonk |
| 4,240,271 | A | 12/1980 | Brownlow |
| 4,790,436 | A | 12/1988 | Nakamura |
| 5,469,987 | A | 11/1995 | Honkawa |
| 5,516,001 | A | 5/1996 | Muckenfuhs |
| 5,715,971 | A | 2/1998 | Morand |
| 5,718,353 | A | 2/1998 | Kanfer |
| 5,765,718 | A | 6/1998 | Grasso |
| 6,053,356 | A | 4/2000 | Emoff |
| 6,158,614 | A | 12/2000 | Haines |
| 6,220,435 | B1 | 4/2001 | Nobile |
| 6,299,027 | B1 | 10/2001 | Berge |
| 6,431,380 | B1 | 8/2002 | Branson |
| 6,634,037 | B2 | 10/2003 | Turbett |
| 6,648,132 | B1 | 11/2003 | Smouha |
| D499,288 | S | 12/2004 | Taylor |
| 6,899,250 | B2 | 5/2005 | FitzSimons |
| 6,948,643 | B1 | 9/2005 | Lohrman |
| 8,777,053 | B2 | 7/2014 | Bunoz |
| D719,373 | S | 12/2014 | Hawry |
| D764,208 | S | 8/2016 | Shafran |
| D818,288 | S | 5/2018 | Lambert |
| 10,213,067 | B2 | 2/2019 | Roberts |
| D877,528 | S | 3/2020 | Davies |
| 10,694,903 | B1 | 6/2020 | Wexler |
| D916,492 | S | 4/2021 | Wexler |
| 2004/0084471 | A1 | 5/2004 | Taylor |
| 2004/0173635 | A1 | 9/2004 | Bunoz |
| 2005/0067313 | A1 | 3/2005 | Banik |
| 2005/0109871 | A1 | 5/2005 | Mitchell |
| 2006/0118567 | A1 | 6/2006 | Linnebur |
| 2006/0157496 | A1 | 7/2006 | Tagliareni |
| 2006/0261076 | A1 | 11/2006 | Anderson |
| 2006/0283752 | A1 | 12/2006 | Alegre de Miquel |
| 2006/0283873 | A1 | 12/2006 | Bostic |
| 2008/0078857 | A1 | 4/2008 | Parietti |
| 2009/0120951 | A1 | 5/2009 | Titas |
| 2009/0200331 | A1 | 8/2009 | Bunoz |
| 2009/0223993 | A1 | 9/2009 | Lorenzati |
| 2010/0032445 | A1 | 2/2010 | Bunoz |
| 2010/0300915 | A1 | 12/2010 | Kakura |
| 2011/0011767 | A1 | 1/2011 | Gehring |
| 2011/0192862 | A1 | 8/2011 | Knudsen |
| 2011/0309099 | A1 | 12/2011 | Bandoh |
| 2012/0211509 | A1 | 8/2012 | Granger |
| 2012/0305587 | A1 | 12/2012 | Williford |
| 2013/0075417 | A1 | 3/2013 | Granger |
| 2013/0313279 | A1 | 11/2013 | Sudworth |
| 2014/0374433 | A1 | 12/2014 | Wilson |
| 2015/0021351 | A1 | 1/2015 | Kaneko |
| 2015/0196176 | A1 | 7/2015 | Felix |
| 2015/0250364 | A1 | 9/2015 | Yamada |
| 2015/0374182 | A1 | 12/2015 | Delaney |
| 2016/0143490 | A1* | 5/2016 | Yamada ..... A47K 10/426 221/1 |
| 2017/0245699 | A1 | 8/2017 | Keily |
| 2017/0354299 | A1 | 12/2017 | Schöler |
| 2018/0153359 | A1 | 6/2018 | Ziebart |
| 2019/0246849 | A1 | 8/2019 | Adams |

FOREIGN PATENT DOCUMENTS

| | | | |
|---|---|---|---|
| EP | 1000577 | A1 | 5/2000 |
| GB | 1406124 | A | 9/1975 |
| WO | 0102266 | | 1/2001 |
| WO | 2001005679 | A1 | 1/2001 |
| WO | 0241742 | | 5/2002 |
| WO | 2010068590 | | 6/2010 |
| WO | 2017218125 | | 12/2017 |

OTHER PUBLICATIONS

Patent Cooperation Treaty, International Searching Authority, Notification of Transmittal of the International Search Report and the Written Opinion of the International Searching Authority, or the Declaration, issued in International Application No. PCT/US2019/067736, dated Apr. 27, 2020, 11 pp.

* cited by examiner

WIPE DISPENSER AND RELATED METHODS

CROSS-REFERENCE TO RELATED APPLICATIONS

This application is a continuation of U.S. application Ser. No. 16/234,915, filed Dec. 28, 2018, both of which are incorporated herein by reference in their entireties.

FIELD

The present invention relates to dispensers, and more particularly, to wipe dispensers, systems and methods relating to same.

BACKGROUND

Disposable wipes are often sold in disposable wipe containers. The wipes are typically sheets of paper or cloth and may be dry or pre-moistened. For example, in healthcare facilities, disposable pre-moistened wipes often include disinfectant or sanitizing formulas. Wipes intended for use on infant skin are also typically sold as pre-moistened wipes.

In many conventional dispensers, it is advantageous to provide a wipe dispenser to house the disposable wipe cartridges. Dispensers often include a lid to cover the wipe cartridge and wipes when not in use. Even in the closed position, ambient air may pass through spaces between lid and the dispenser (or through other apertures in the dispenser) and into the wipe cartridge. Over time, the air dries out the pre-moistened wipes, rendering the wipes less desirable or even unfit for their intended use. Air gaps in the dispenser may also allow bacteria to enter into the interior of the wipe cartridge.

Conventional dispensers also often require surface space, such as on a tabletop, countertop, or the like, which is not always readily available. For example, in healthcare facilities, such as a doctor's exam room, there is typically not much surface space to rest a conventional dispenser. In many such offices, there is only a very small countertop with a sink for washing of hands, etc., and such countertops are often already occupied via swabs, facial tissue, and other daily use items (e.g., electronics, such as computer terminals, handouts or brochures, boxes with gloves, etc.).

In addition to being a problem with lack of surface space, it is also often desired to keep medical related items off of surfaces so that these healthcare facilities can be cleaned more easily and thoroughly. When dispensers are left on a surface they require the cleaning personnel to move them to clean the surface underneath and sometimes they do not get moved leaving the surface underneath untouched. To solve this, many items used in healthcare facilities are wall mounted. Wall mounted items are typically not readily removable/replaceable and often require extra labor to install, remove and replace, and to ensure proper alignment or installation.

Accordingly, there is a need for a dispenser and methods relating to same that overcome the aforementioned limitations and which further provide capabilities, features and functions, not available in current dispensers

BRIEF DESCRIPTION OF THE DRAWINGS

The above and other aspects, features and advantages of several embodiments of the present invention will be more apparent from the following more particular description thereof, presented in conjunction with the following drawings.

FIG. 9A is a front perspective view of the dispenser of FIGS. 1-8 taken from a different orientation and showing the disposable wipe bag or container removed from the wall mount support bracket and illustrating how the collar of the disposable wipe bag can be aligned with the wall mount support bracket for installation there in or on;

Figure 1:
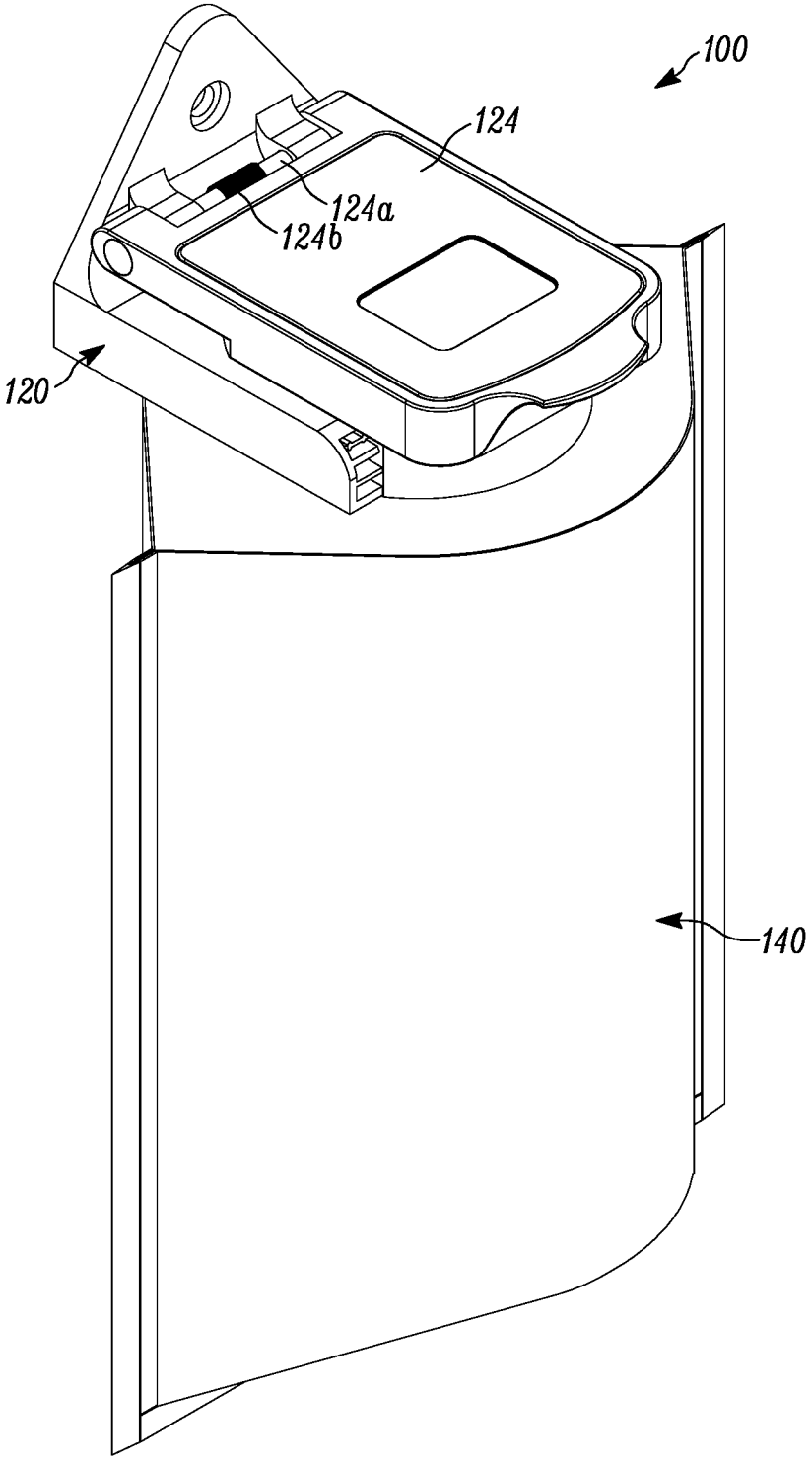
FIG. 1 is a perspective view of a dispenser in accordance with aspects of the present invention illustrating a wall mounted wipe dispenser with a wall mounted support bracket that allows for quick installation or removal and replacement and a lid or cover for sealing the dispenser to prevent wipes from drying out.
Figure 2:
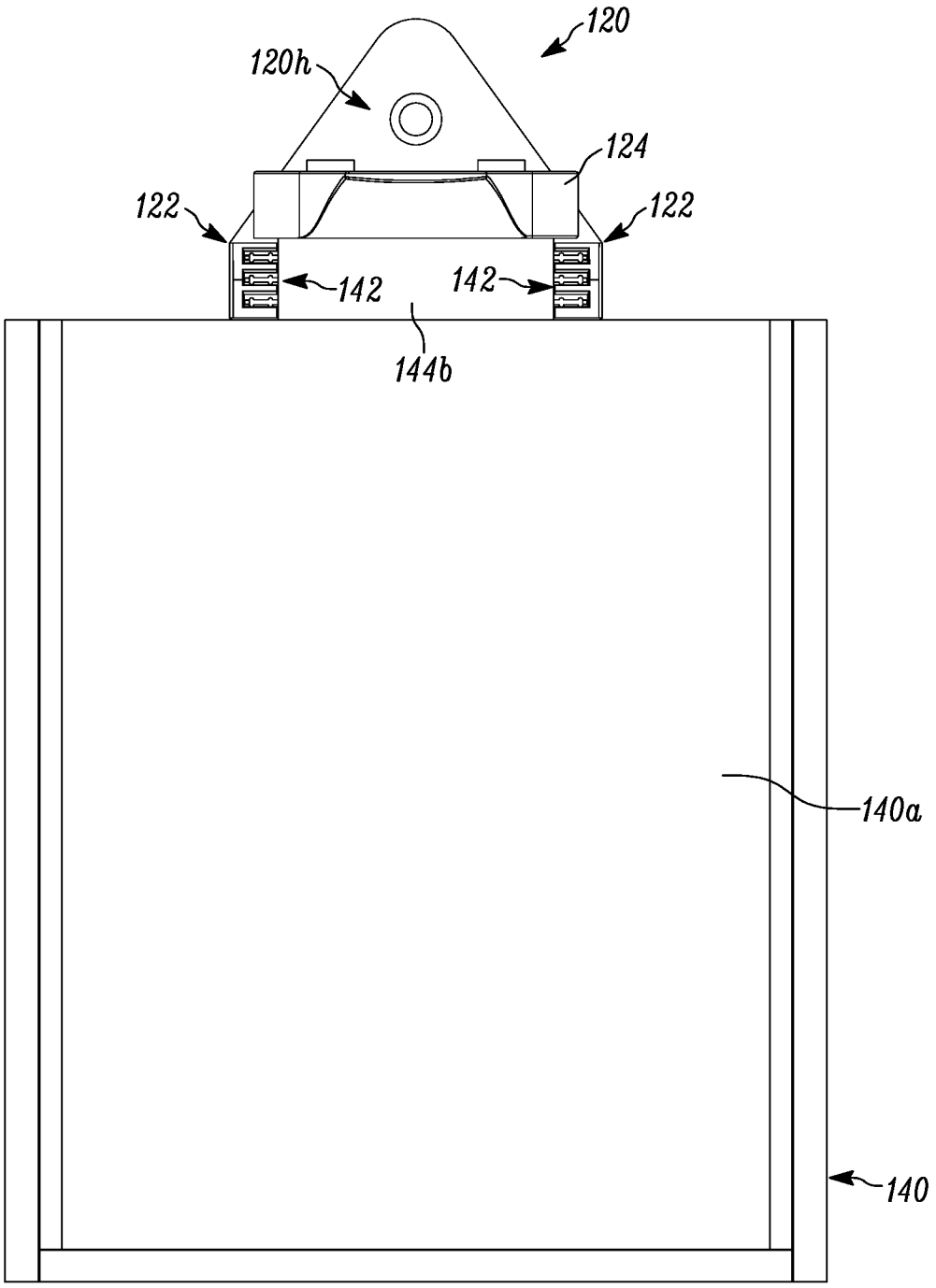
FIG. 2 is a front elevation view of the dispenser of FIG. 1.
Figure 3:
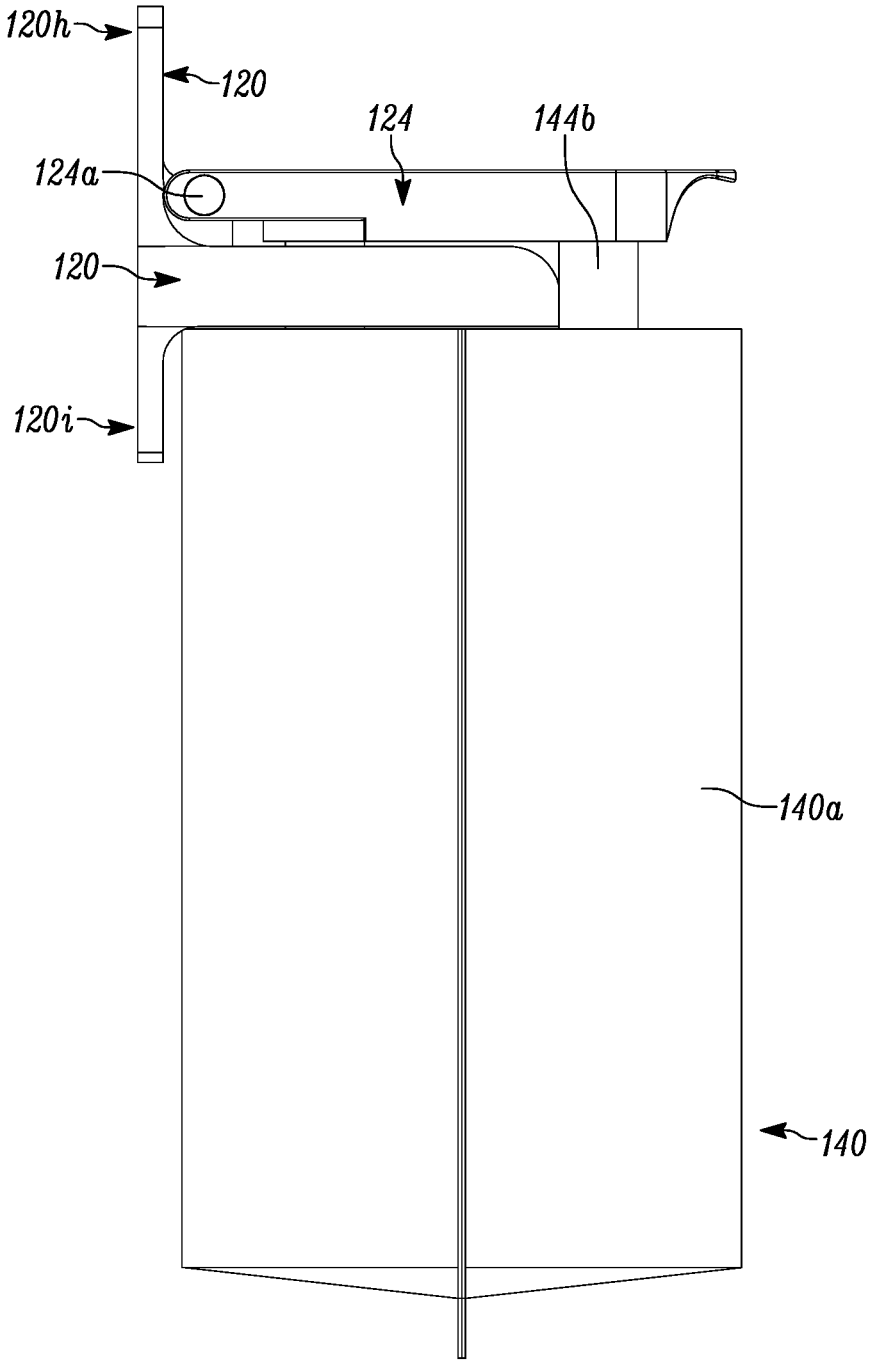
FIG. 3 is a left-side elevation view of the dispenser of FIGS. 1-2.
Figure 4:
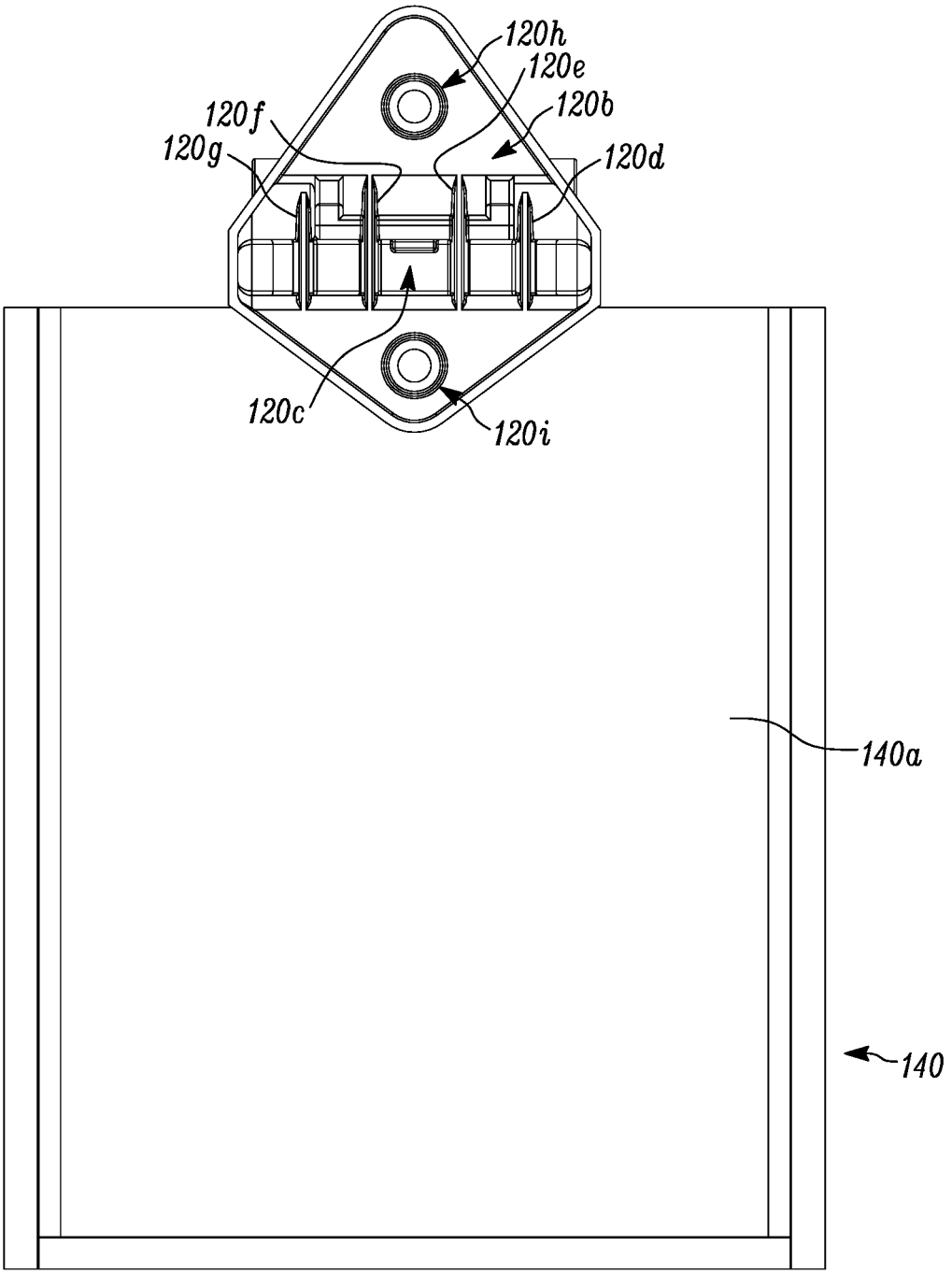
FIG. 4 is a rear elevation view of the dispenser of FIGS. 1-3.
Figure 5:
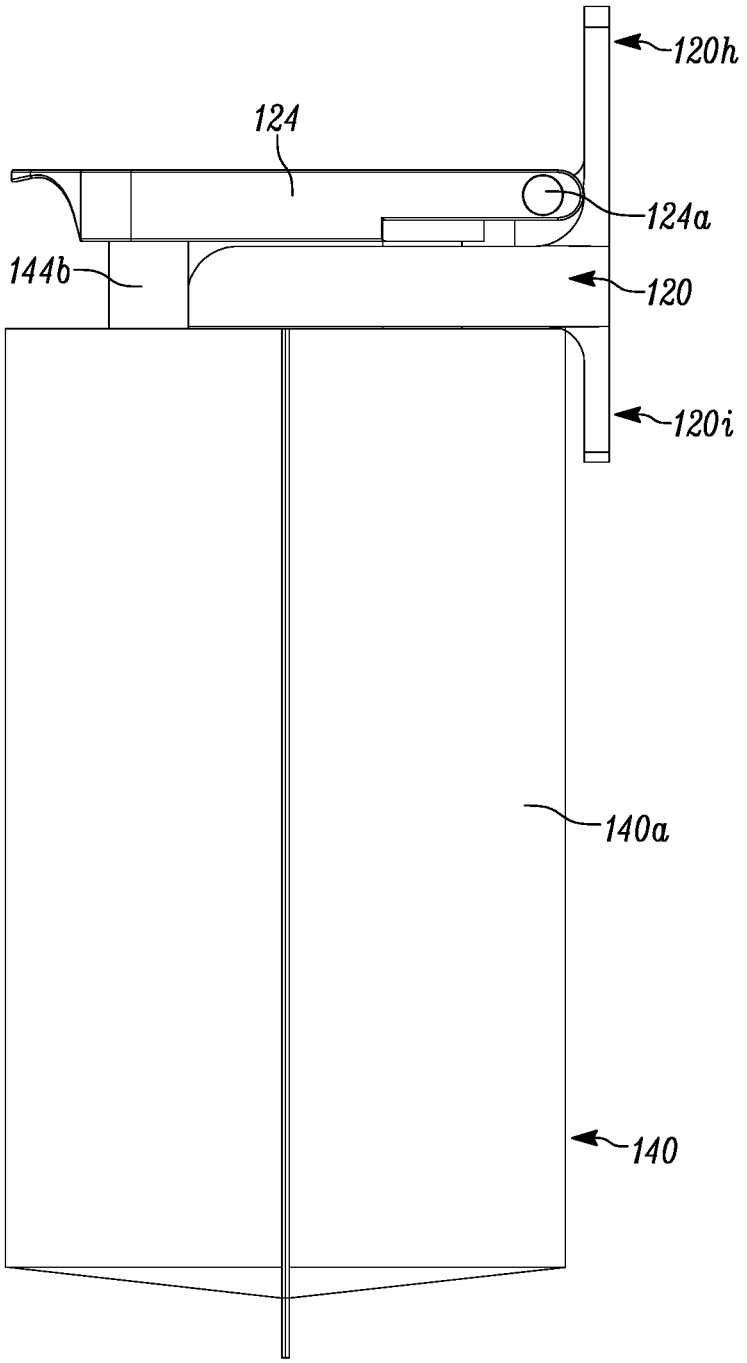
FIG. 5 is a right-side elevation view of the dispenser of FIGS. 1-4.
Figure 6:
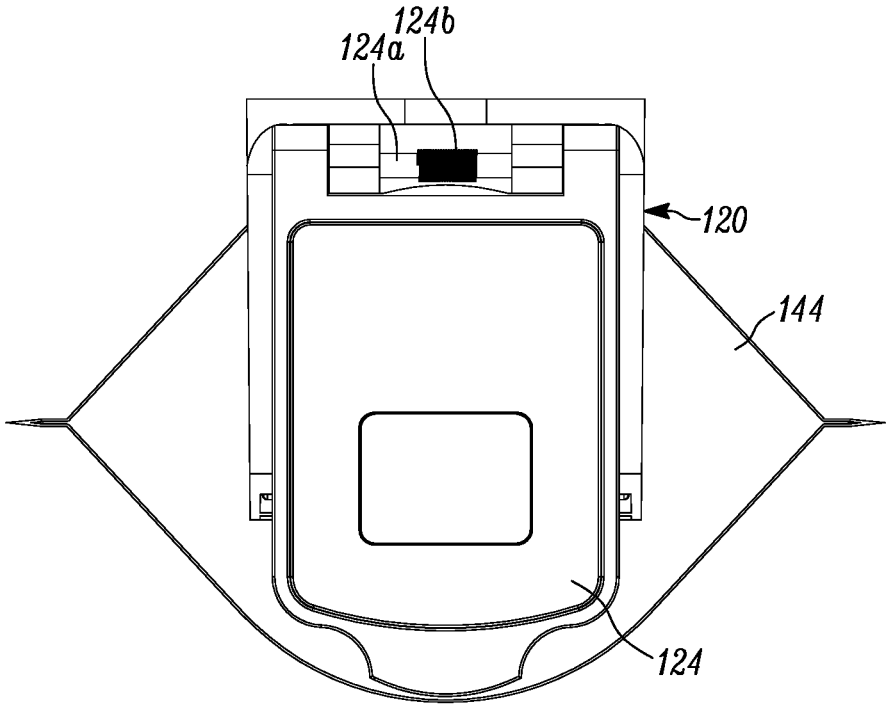
FIG. 6 is a top view of the dispenser of FIGS. 1-5.
Figure 7:
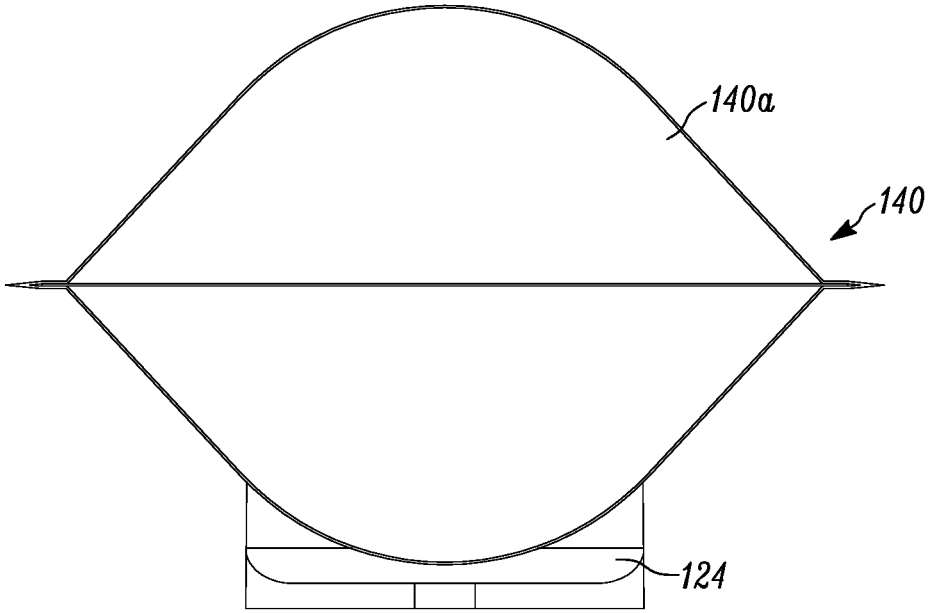
FIG. 7 is a bottom view of the dispenser of FIGS. 1-6.
Figure 8:
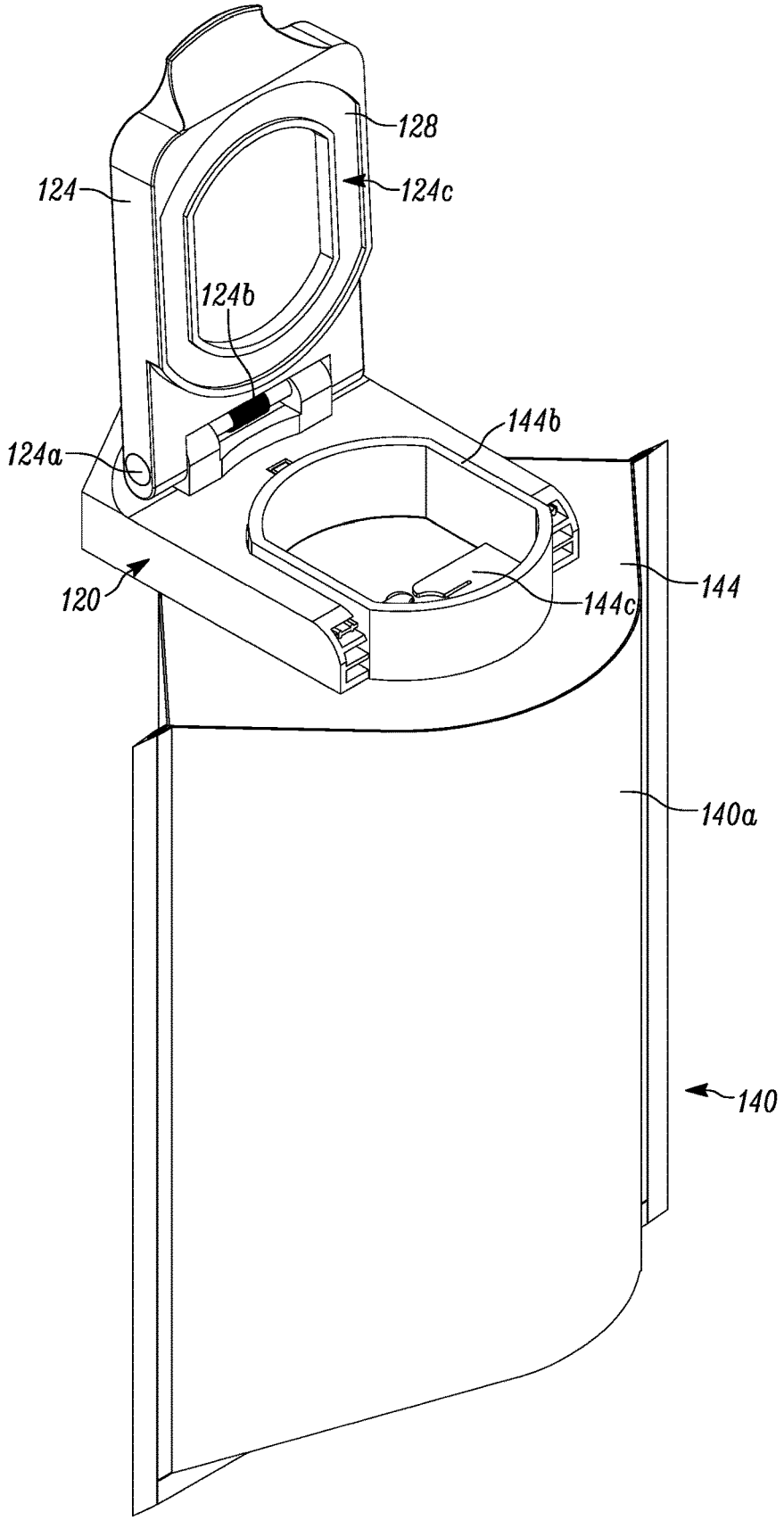
FIG. 8 is another perspective view of the dispenser of FIGS. 1-6, but illustrating the lid or cover of the wall mounted support bracket in the open position instead of closed.
Figure 9A:
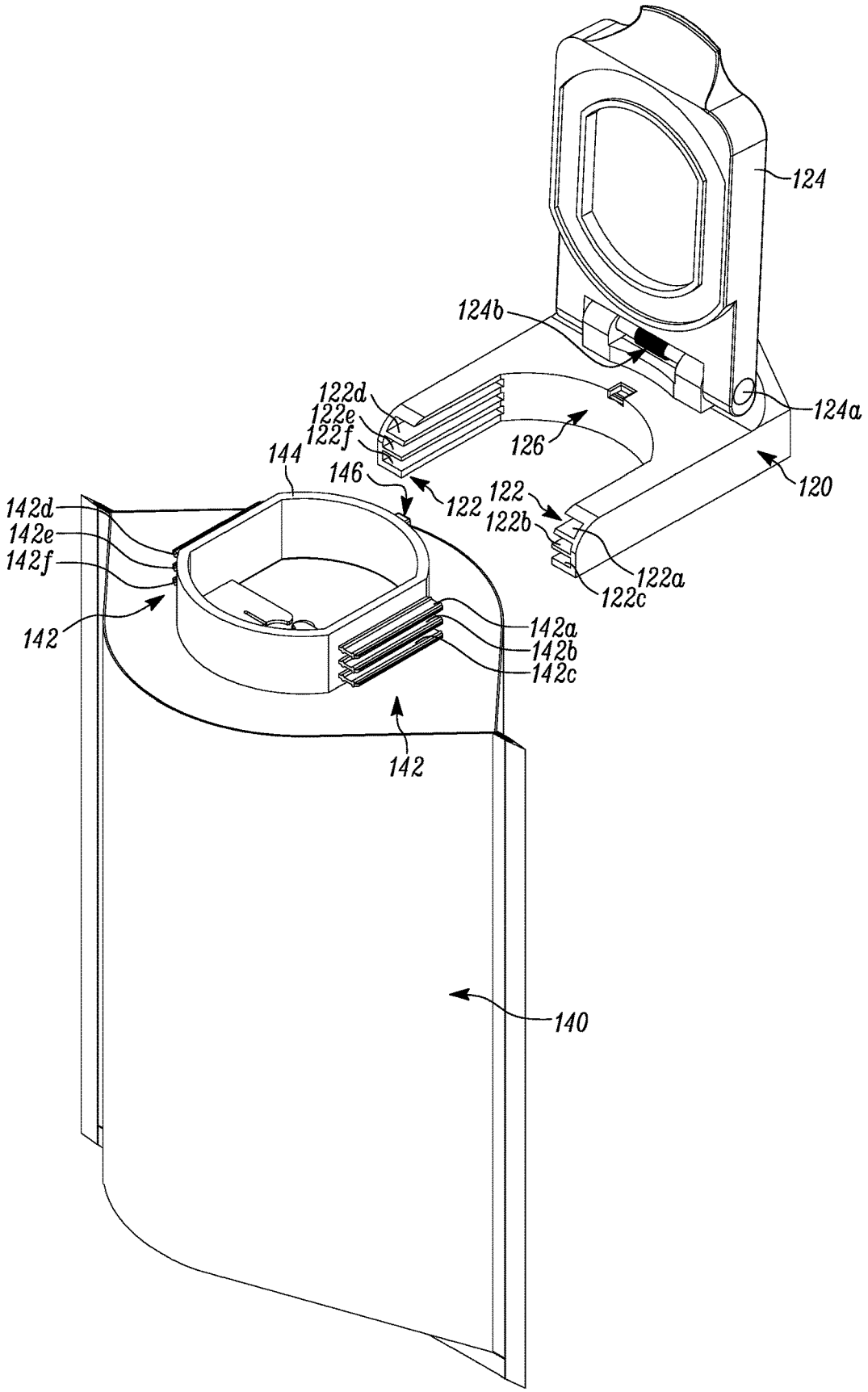
Figure 9B:
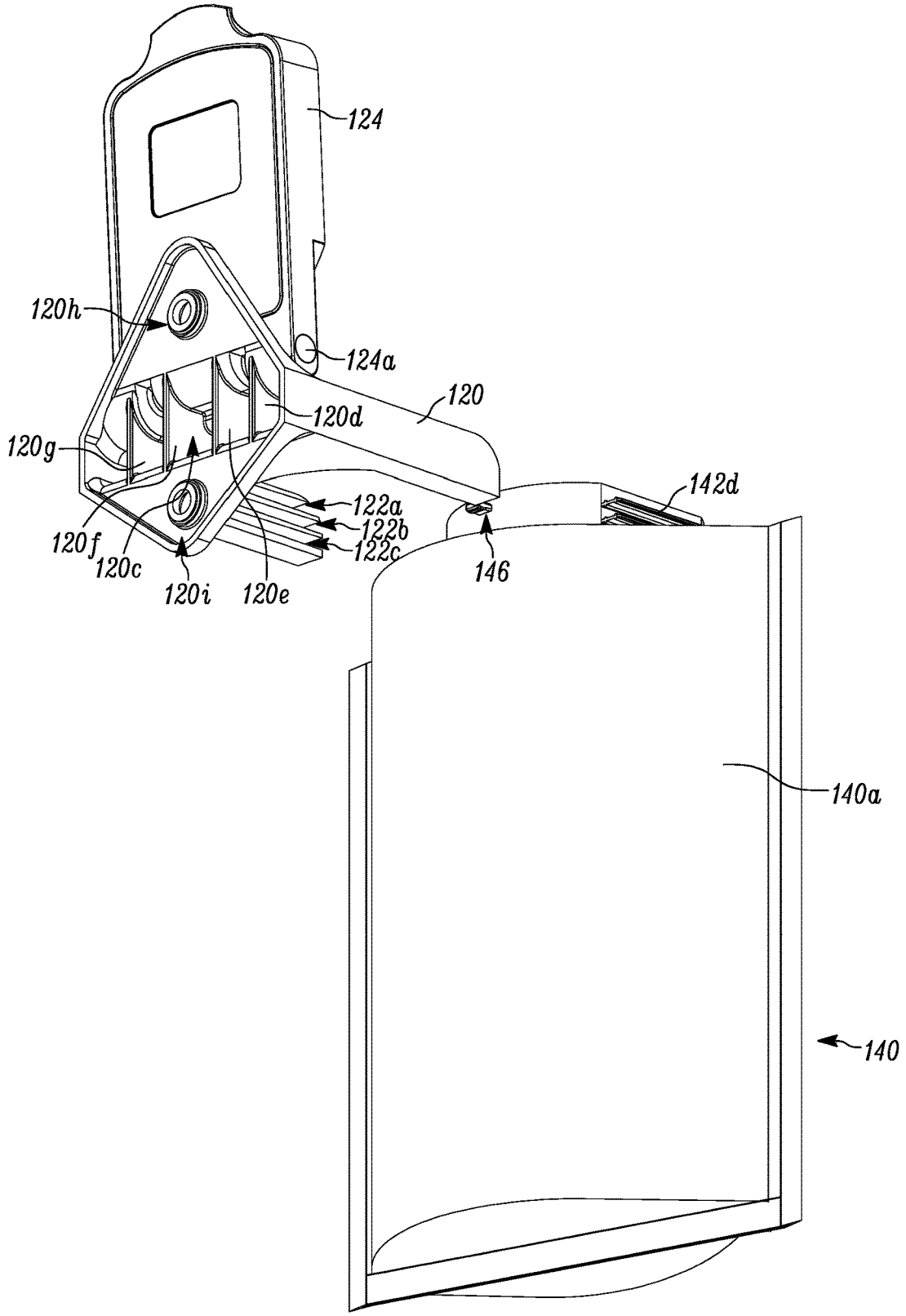
FIG. 9B is a rear perspective view of the dispenser as illustrated in FIG. 9A.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. References to top, left, front, right and other points of direction are for internal reference and are not intended to limit the orientation of the dispenser in use.

DESCRIPTION OF THE PREFERRED EMBODIMENTS

With reference to FIGS. 1-11B, an exemplary dispenser or system for dispensing items such as wipes is illustrated. The system provides a wall mount support bracket for suspending a disposable wipe bag from the wall so as not to require surface space for the wipes. The system allows for easy initial installation of the wipes dispenser, and then for even easier removal and replacement of wipes once the bag of wipes is depleted. The wall mount support bracket also features a self-sealing cover or top that seals the wipe bag shut so that the wipes do not dry out. In this way, less packaging is required for the actual wipes container and a more desirable, wall mounted, arrangement can be provided. In preferred forms, the system will also include a secondary mating structure arrangement that confirms for the user the proper alignment for the replacement bag of wipes and/or when the replacement bag is fully installed on the wall mount to ensure proper sealing of the bag of wipes via the wall mount cover or lid. As used herein, the term "wipes" refers to sheet portions that may be, for example, a paper or non-woven cloth. The sheet portions may form a continuous sheet with perforations to allow a user to tear the sheet into discrete wipes. The sheet portions may instead take the form of pre-cut discrete wipes. Pre-cut wipes are typically a perforated roll of wipes where each wipe is interlocked with adjacent wipes such that removal of a first wipe pulls the next wipe partially through a retainer located in the dispenser leaving a portion of it positioned for the user (or next user) to grab. The wipes may be pre-moistened during manufacture by applying a liquid disinfectant, sanitizing, or lubricating formula. In alternate forms, however, the wipes may also be dry wipes that may be used, for example, as wiping or absorbing sheets. The self-sealing cover of the dispenser disclosed herein is still beneficial when dealing with dry wipes in that it helps prevent the wipes from contamination such as by picking-up lint or dust particles.

Turning now to FIGS. 1-11B, in a preferred form system 100 includes a wall mount support bracket 120 and a disposable wipe dispenser bag or container 140. The wall mount support bracket 120 includes a first mating structure 122 (see FIG. 9A) which mates with a corresponding first mating structure 142 on disposable wipe bag 140. In the form shown, the first mating structure 142 of disposable bag 140 comprises protruding members, such as ribs 142*a-f*, which extend from collar 144 and mate with aligning recesses, such as channels 122*a-f*, located on wall mount support bracket 120. While the first mating structures 122 and 142 illustrate a protruding member for wall mount first mating structure 122 and a mating recess for wipe bag first mating structure 142, it should be understood that in alternate embodiments this may be reversed (e.g., wherein the protruding member is located on the wall mount 120 and the mating recess is on the dispenser bag 140) or that interchanging mating structures may alternatively be used (e.g., wherein both the dispenser bag 140 and wall mount 120 have a protruding member and a recess that mate with corresponding recesses and protruding members, respectively).

In addition to the first mating structures 122 and 142, the dispenser system 100 further includes a second wall mount mating structure 126 and a second dispenser bag mating structure 146 for mating with one another to ensure proper bag dispenser alignment and installation. In the form shown, the second wall mount mating structure is a recess and the second dispenser bag mating structure 146 is a protrusion which mates with recess 126. More particularly, protrusion or tab 146 friction fits into the recess 126 to give the system user a tactile and/or visual assurance that the dispenser bag 140 has been properly installed on wall mount support bracket 120. In a preferred form, the second mating structures 126, 146 will give both tactile and visual assurance in this regard so that the user will know they have the dispenser bag 140 properly installed on the wall mount support bracket 120 such that: (i) the dispenser bag wipe retainer 148 is positioned correctly to allow for wipes to be removed and the following wipe to be properly positioned for the next user of the dispenser; and (ii) such that the wall mount dispenser lid or cover 124 is properly aligned to seal the wipe dispenser bag 140 when cover 124 is in the closed position. In some forms, the second mating structures, 126, 146 may also provide audible assurance that the wipes dispenser 140 has been properly connected to the wall mount support bracket 120 by providing a click or similar noise when the tab 146 is properly inserted into recess 126. In some forms only one of the tactile, visual or audible assurance features may be used, while in others two or more of them may be provided (e.g., tactile and visual in some forms, tactile in audible in others, audible and visual in still others, etc.).

While the illustrated embodiment shows the dispenser bag collar 144 having the protrusion and the wall mount support bracket 120 having the mating recess, it should be understood that (like the first mating structures), these mating structures may be reversed so that the collar 144 defines the mating recess and the wall mount support bracket 120 has the mating protrusion. Similarly, in still other forms, a plurality of these structures may be provided on each of the collar 144 and bracket 120 and these plurality of structures may be of the same type (e.g., all recess on one and all protrusions on the other) or they may alternate in type (e.g., one or more protrusions and recesses on the collar and one or more mating recesses and protrusions on the bracket).

In addition to the first and second mating structures 122, 142 and 126, 146, respectively, the wipe dispensing system 100 will also include a wall mount support bracket cover 124 (e.g., cap, lid, etc.) which seals the opening of dispenser bag 140 when the dispenser bag is properly installed on the wall mount support bracket 120. In a preferred form, the cover 124 will be movable between an open and closed position and biased in the closed position to ensure that the wipe dispenser 140 is sealed so that the wipes do not dry out or become contaminated by dust or other foreign particles. In the form shown, the cover 124 is connected to the wall mount support bracket 120 via a hinge 124*a* and is biased in the closed position via spring 124*b*. The cover 124 also will preferably include a gripping area, such as the protruding tab shown at the front of the cover, to make the cover easier to grasp and open. In the form shown, the cover 124 includes a protruding tab, but the adjacent portion of the wall mount support bracket 120 is also recessed in this point to make the gripping surface area even larger so that the cover 124 is easier to open. In the form illustrated, the bracket 120 is configured to hinder a user from raising the cover more than ninety degrees (90°) because of the proximity the cover will have to the wall (not shown). In alternate forms, a protrusion or stop may be used to prevent the cover 124 from being raised more than ninety degrees (90°) to assist the spring in being able to close the cover 124 when wipes are not being dispensed.

In a preferred form, the cover will also include a seal 128 which aligns with the perimeter wall 144*b* that forms the central opening of the rigid collar 144 through which wipes are dispensed. In a preferred form, the seal 128 is a flat rubber gasket that nests within a channel 124*c* formed in cover 124 (see FIG. 8) and which prevents air and other foreign particles from entering the inner portion of wipe dispenser bag 140 which could dry out and/or contaminate the wipes 160. By being biased in the closed position, cover 124 prevents the risk that a user could inadvertently leave the cover 124 open causing the wipes to dry out and/or be contaminated in this way. In addition, the cover will include a recessed portion in the upper surface thereof to provide a place for a sticker indicating the type of wipes disposed within system 100. This may be a sticker indicating a brand, a type of wipe (e.g., disinfectant, wet, dry, etc.), instructions relating to the wipe (e.g., contact time for the disinfectant or similar EPA registration time, etc.). In a preferred form, the cover will also include indicia for identifying the maker of the dispenser system 100.

In a preferred form, the wall mount support bracket 120 will be formed by injection molding and will include a generally hollow rear 120*b* (see FIG. 4) and central space 120*c* to cut down on material needs and costs and improve the moldability of the bracket 120. To achieve this, the bracket 120 is formed with internal ribs 120*d-g* to provide structure support to the bracket 120 despite its substantially hollow nature. In addition to this structure, the bracket 120 will further include first and second mounting portions 120*h*, 120*i*, respectively, for mounting the bracket 120 to a wall. In a preferred form, the mounting structures 120*h*, 120*i* will be vertically aligned openings through which fasteners may be disposed in order to suspend the bracket 120 on a common sturdy wall support, such as the stud of a wall. By using two separate mounting structures 120*h*, 120*i*, the bracket 120 is further designed to resist twisting or torsion/torque of the bracket when being installed and used. This structure also makes it easier to mount the bracket 120 level as a fastener can be connected to the first mounting structure 120*h* and before tightening, the bracket 120 can be allowed to come to rest in order to use the assistance of gravity to properly align the second mounting portion 120*i*.

Figure 10A:
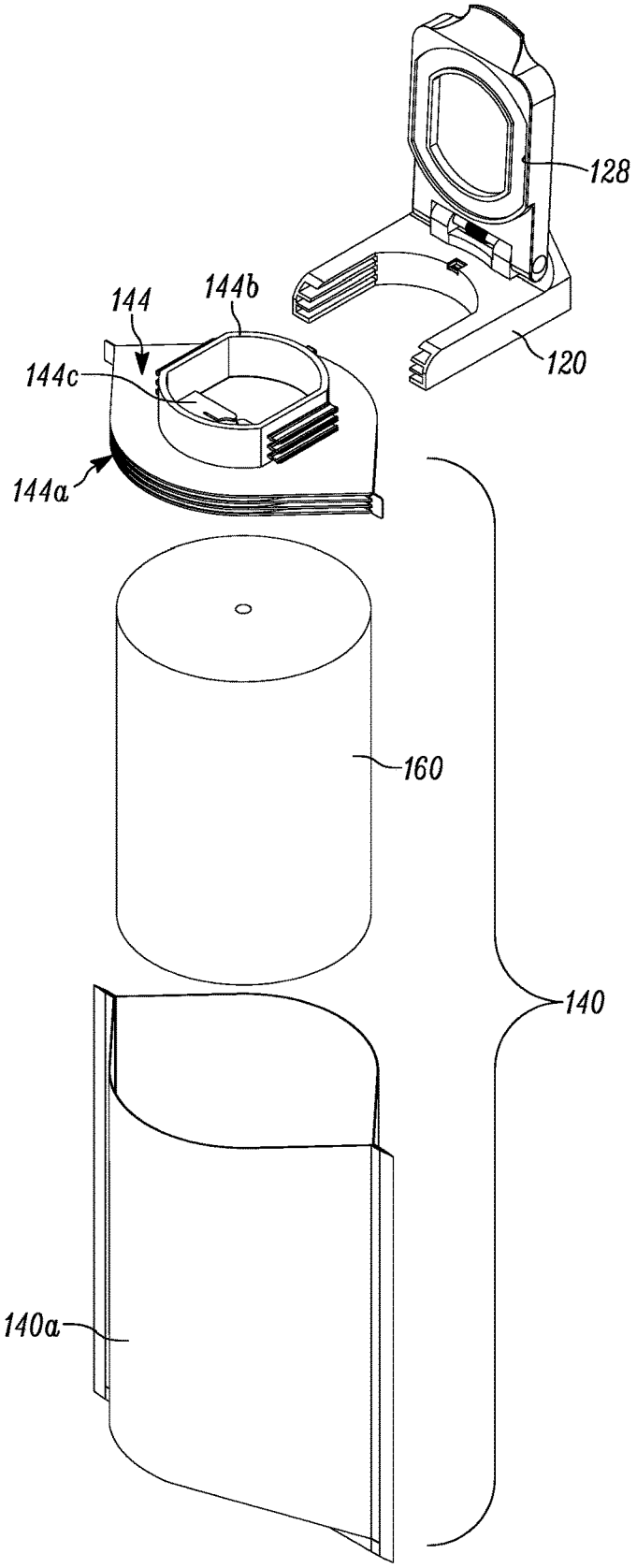
FIG. 10A is another front perspective view of the dispenser as illustrated in FIG. 9A showing the parts of the disposable wipe bag or container exploded so that the wipes are visible and the relationship between the rigid collar of the bag and the bag can be understood.
Figure 10B:
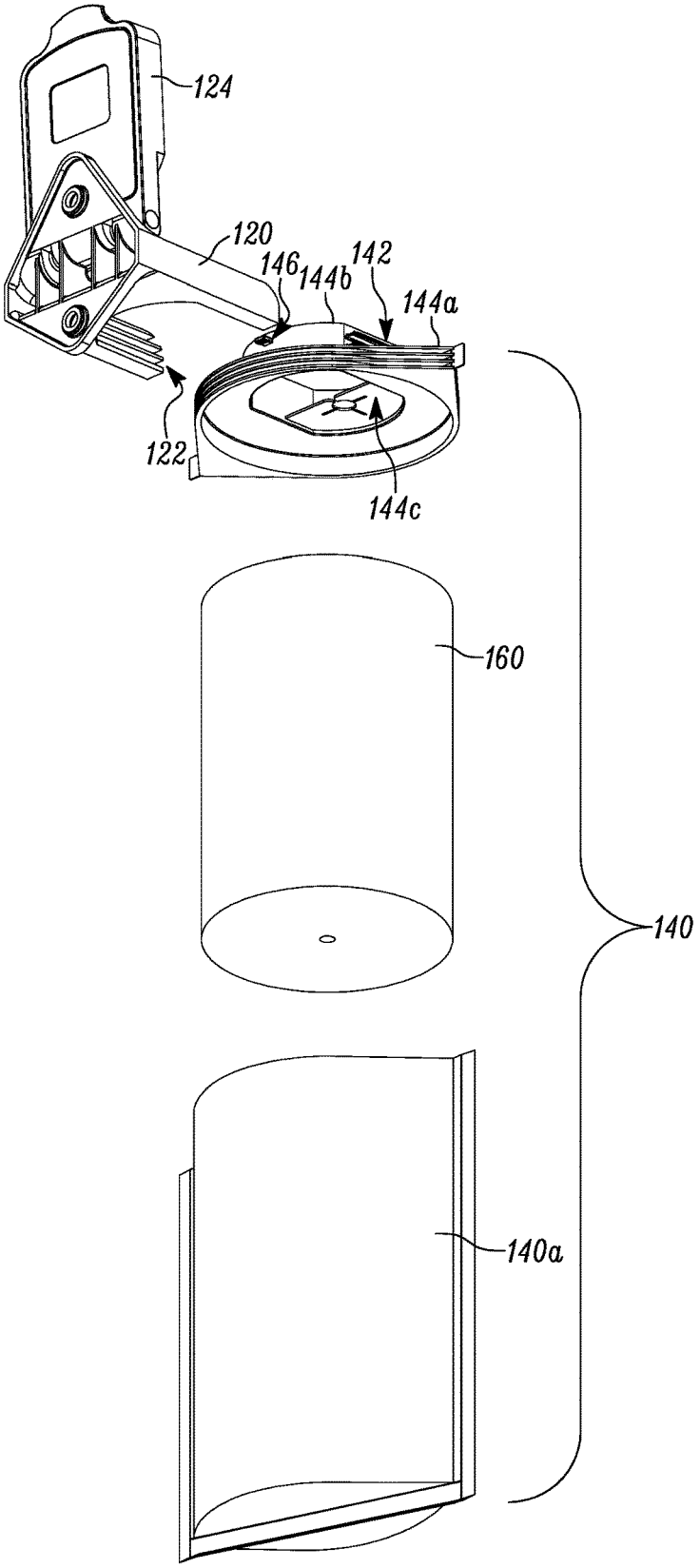
FIG. 10B is a rear perspective view of the dispenser as illustrated in FIG. 10A.
Figure 11A:
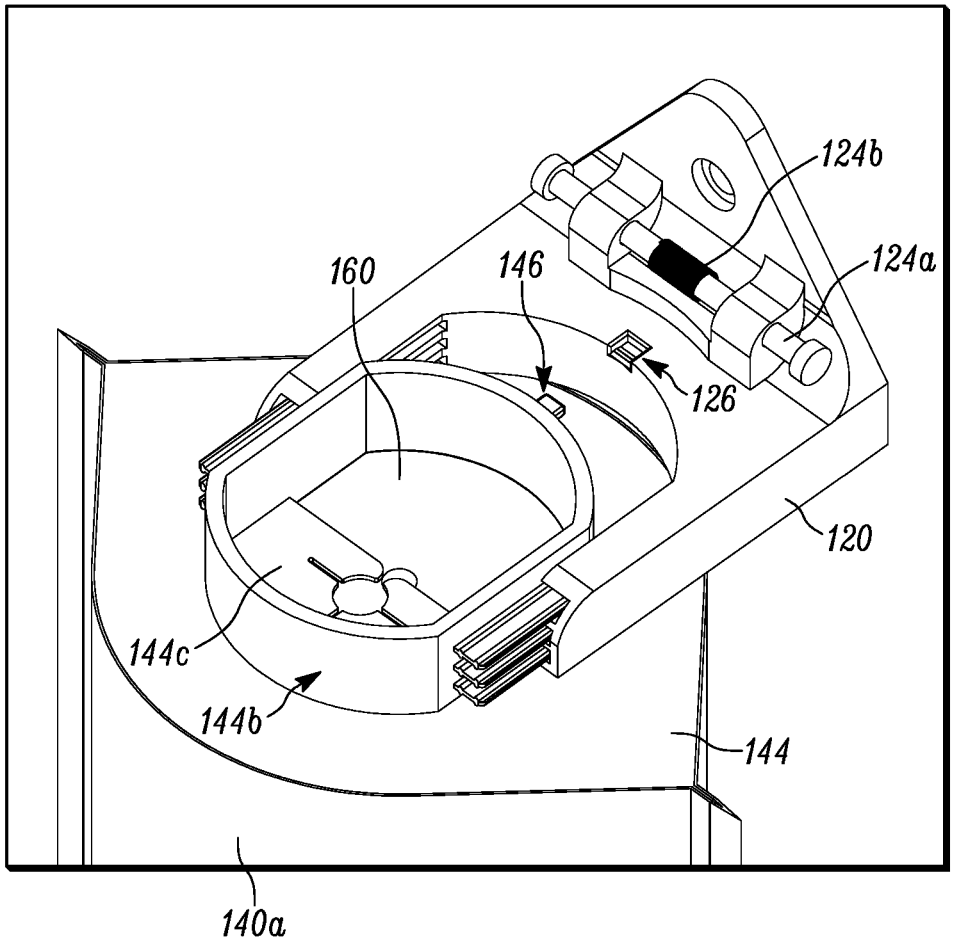
FIG. 11A is an enlarged view of a portion of the dispenser of FIGS. 1-10B illustrating the disposable wipe bag or container partially installed on the wall mount support bracket and the wall mount support bracket lid removed so that the mating structures of the disposable wipe bag collar and wall mount support bracket may be seen in alignment with one another, but not yet mated with one another.
Figure 11B:
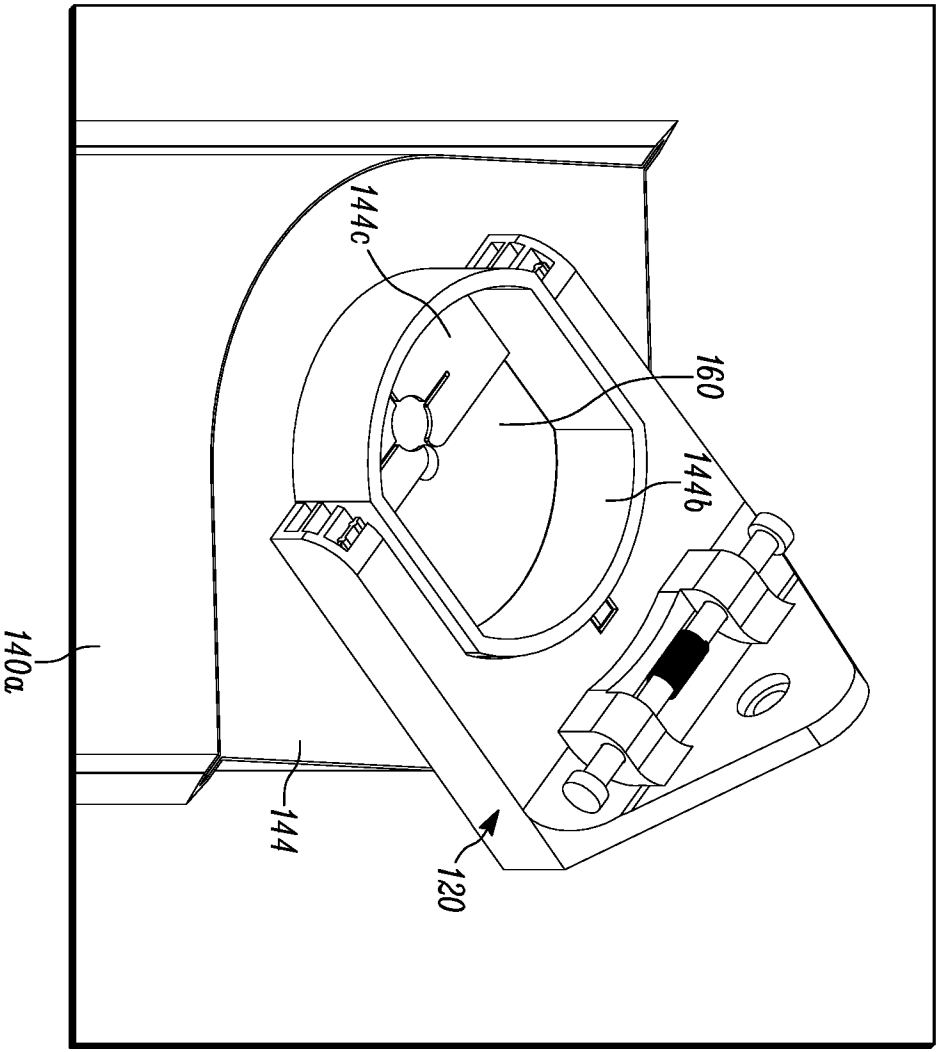
FIG. 11B is the enlarged view of FIG. 11A illustrating the mating structures mated with one another which confirms proper installation and alignment of the disposable wipe bag so that the wall mount support bracket lid can properly close to seal the wipes dispenser bag.

As can best be seen in FIG. 10A, the wipe dispenser bag 140 includes the rigid collar member 144, a roll of wipes 160 and an outer bag or container 140*a*. The rigid collar 144 includes a perimeter wall 144*b* that defines the central opening through which wipes 160 are dispensed and includes a wipe retainer 144*c* through which wipes 160 are pulled to separate one wipe sheet form another. The perimeter wall 144*b* is preferably oblong in horizontal cross-section having two curved ends on opposite sides of the central opening and two straight sides forming the other sides of the central opening. The above-mentioned mating structures 142*a-f* preferably extend from the exterior of the straight side walls of the perimeter wall 144*b* so that elongated ribs or surfaces may be formed as protrusions 142*a-f* to securely mate with mating recesses 122*a-f* of wall mount support bracket. The elongated nature of the ribs 142*a-f* provides greater surface area to suspend the bag dispenser 140 from and, thus, helps support the dispenser bag 140 and securely connect the dispenser bag 140 to the wall mount support bracket 120.

Figure 12:
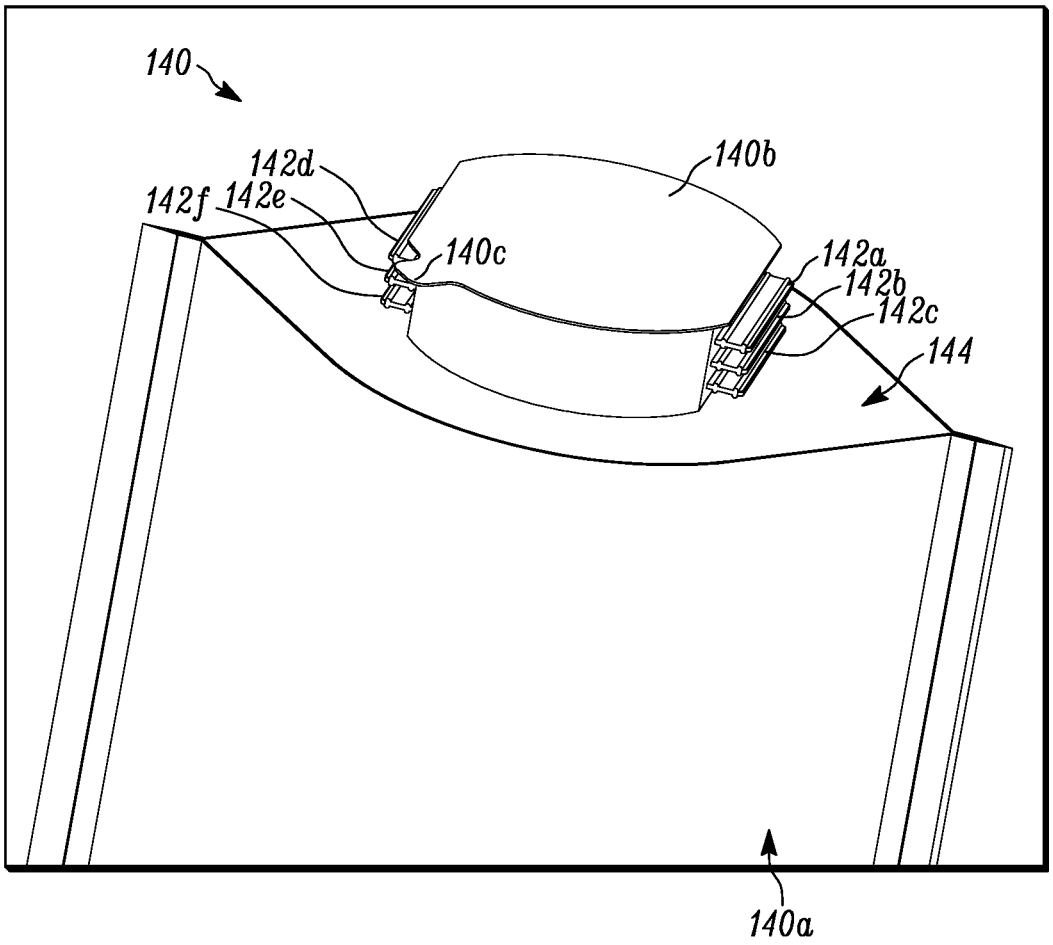
FIG. 12 is an enlarged view of the fitment/rigid collar of the disposable wipe dispenser illustrating the seal the replacement dispensers may be shipped with which will be removed prior to use of the wipes.

The rigid collar portion 144 of dispenser bag 140 preferably forms an upper wall of the wipes dispenser structure 140 and has a side or perimeter wall 144*a* to which the bag 140*a* is sealed. In a preferred form, the side wall 140*a* includes ridges to add surface area and assist with heat sealing or welding the upper edges of bag 140*a* to side wall 144*a* of rigid collar 144. In the form shown, rigid collar 144 is canoe-shaped (or rounded in the middle and pointed on the ends) (as viewed from above) to make it easier to heat seal the bag 140*a* to the collar 144. The size of the collar 144 gives structure for the shape of the bag 140*a* to fit the roll of wipes 160. As best seen in FIG. 10A, the rigid collar side wall 144*a* has four ribs or protrusions separated by recessed space that collectively assist with supporting the weight of the wipes 160 when the bag 140*a* is heat sealed to rigid collar 144 (and in particular side wall 144*a*). In a preferred form, replacement disposable wipe dispenser bags 140 will be sold to connect to the existing wall mount support bracket 120 when the current dispenser bag is out of wipes and these dispenser bags 140 will be sealed, such as by a removable cap and/or by a pull seal that can be removed prior to installing the bag 140 on the bracket 120. In one form, a plastic or foil seal 140*b* (see FIG. 12) is used to seal the opening of the fitment/rigid collar 144 and will be removed prior to use. The foil seal 140*b* may include a tab or pull member 140*c* for ease of opening the seal 140*b* and the seal itself would preferably be heat-sealed to the fitment/rigid collar 144. The cap or seal 140*b* can be removed before or after the dispenser bag 140 is installed on the mount 120 and, once removed, the bag 140*a* of wipes 160 will be sealed by cover 124.

In a preferred form, the bag 140*a* will be of a two-ply construction and will be formed by pinch/heat sealing the sides of bag 140*a* initially to form a sealed receptacle with an upper opening that is ultimately sealed to side wall 144*a* of rigid collar 144 (e.g., via heat welding). Once the wipes are installed in the bag 140*a*, the bottom of the bag 140*a* is also pinch/heat sealed to seal the wipes 160 in bag 140*a*. In the form shown the bag is assembled by having two separate two-ply wall members aligned with one another and then pinch/heat sealed at their sides and the bag 140*a* sealed to rigid collar 144 (in this form, specifically to side wall 144*a*). Then the wipes 160 are inserted in the bag 140*a* and the bottom of the bag is pinch/heat sealed shut. Since the central opening of collar 144 is sealed via a pull-off seal or cap, the wipes bag dispenser 140 is hermetically sealed until the pull-off seal or cap is removed. Once the bag dispenser 140 is mounted to support bracket 120, however, cover 124 (and in this form seal 128) will again seal the dispenser 140 to prevent the wipes from drying out and/or being contaminated by air particles/particulates. The bag 140*a* is of sufficient length to accommodate the roll of wipes 160 and to properly suspend the wipes closely below the retainer 144*c* of rigid collar member 144 and centrally aligned with perimeter wall 144*b* so that as one wipe sheet (or first wipe) is pulled from retainer 144*c*, the next wipe (or second wipe) starts its way through retainer 144*c* until the first wipe sheet tears from the second wipe sheet.

In the form shown (and as best seen in FIGS. 8, 9A, 10A and 11A-B), the retainer 144*c* is preferably recessed below the upper surface of perimeter wall 144*b* of collar 144. The rigid collar 144 defines an enlarged opening via wall 144*b* and the recessed nature of retainer 144*c* forms a recessed well that provides ample space for the next wipe to rest in the retainer without drying out and makes the next wipe easier to be dispensed. The retainer 144*c* preferably defines a circular opening that has four cuts or slits located opposite one another to form flaps in the retainer 144*c* that are flexible and allow the wipe to be fed through the substantially circular opening defined by the retainer 144*c* and to add just enough resistance to cause the wipe sheet being removed to separate from the remainder of the wipe roll while still leaving the next wipe properly situated in the recessed well of retainer 144*c* and side wall 144*b* to be easily removed by a user when desired. The perimeter wall 144*b* forms an enlarged opening that further makes it easier to remove a wipe from the retainer 144*c* and/or to feed an initial wipe into retainer 144*c* when first being used. Other forms of retainers may be used beyond the one shown, such as a retainer similar to that illustrated in U.S. patent application Ser. No. 14/978,003, filed Dec. 22, 2015 and entitled Dispenser, now published as U.S. Patent Application Publication No. 2017/017259A1, published Jun. 22, 2017, which is incorporated herein by reference in its entirety.

In the form shown, the support bracket 120 is preferably made of a polymer, such as a thermoplastic polymer (e.g., Acrylonitrile butadiene styrene (ABS)) or High Density Poly Ethylene (HDPE)) and the dispenser bag 140 is preferably made of a polyethylene (PE) layer and another layer that is suitable for preventing breakdown when exposed to any chemicals associated with wipes 160, so as to prevent any leaking from bag dispenser 140 (e.g., this other layer may be made of polyethylene terephthalate (PET)/nylon, aluminum, etc.). The purpose of the PE layer is to make the bag 140*a* easier to heat seal to collar 144, however, it should be understood that if the collar 144 is made of different material, the bag 140*a* may be made of another material that is preferred for sealing to whatever material is used for collar 144 (e.g., heat sealing compatibility). Further, while the preferred bag 140*a* is made of a two-ply construction, it should be appreciated that in alternate forms a single-ply (one-ply) or multiple-ply construction other than two-ply (e.g., three-ply, four-ply, etc.) may be used if desired.

The collar 144 is preferably made of HDPE, ABS or polyphenylene ether (PPE). However, as mentioned above, it should be understood that while any of these materials may be used for any of these components (e.g., bracket 120, cover 124, dispenser 140, etc.), in still other forms other blended versions of these materials may be used. For example, in a preferred form, the collar 144 may be made of a blend of PPE & HDPE.

While the above has focused on a wall mounted wipes dispensing system, it should be understood that individual components of same have also been disclosed herein and are intended to be covered by this disclosure. For example, a wall mount support bracket has been disclosed including: a body defining a first mating structure for mating with a disposable wipe dispenser bag, and a center opening to be aligned with an opening of the disposable wipe dispenser bag; and a cover connected to the body and movable with respect to the body between a first, closed position wherein the center opening is sealed and an open, second position wherein the center opening is unobstructed so that wipes can be dispensed therethrough.

The cover of the wall mount support bracket may be connected to the body via a hinge which allows the cover to move between the first and second positions. In some forms, the cover further includes a biasing mechanism for biasing the cover in the first, closed position. The biasing mechanism will preferably be a spring that forces the cover closed and requires active force to be applied to same in order to move the cover to the second, open position.

The wall mount support bracket may also include a seal for sealing the cover to the body when the cover is in the first, closed position. For example, in some forms, the cover defines a channel within which the seal is disposed, and the seal is a rubber gasket for sealing the center opening when a dispenser bag is connected to the wall mount support bracket.

In addition to the wall mounted wipes dispensing system and the wall mount support bracket, there is disclosed herein a disposable wipe dispensing package including: a rigid collar member defining an upper surface of the disposable wipe dispensing package and defining a first mating structure which the disposable wipe dispensing package may be suspended from when mating to a wall mounted support bracket; and a bag connected to the rigid collar member and defining an inner cavity within which a roll of wipes is disposed.

In some forms, the rigid collar member has a main body member and a perimeter wall extending therefrom that defines an opening through which wipes are dispensed. The rigid collar member will preferably include a wipe retainer through which wipe sheets are fed and which assists in separating a first wipe sheet from a second wipe sheet, while maintaining the second wipe sheet in the retainer for later use. In one exemplary form, the bag is a two-ply bag that is composed of at least two separate two-ply sheets that are heat and pinch sealed to one another to define an enclosed bag with an upper opening. It should be understood, however, that in other forms the bag may be a single-ply or a multi-ply construction so long as it is configured to properly contain the wipes that are intended to be contained in the bag.

In some forms, the upper opening is heat welded to a side wall of the rigid collar to fully enclose the inner cavity of the bag and rigid collar except for an opening defined by the rigid collar. The rigid collar may define a ribbed side wall to which the upper opening of the enclosed bag is heat welded to seal the bag to the side wall of the rigid collar.

In addition to the system and apparatus embodiments disclosed herein (e.g., a wipe dispensing system, a wall mount bracket, a wipe dispenser bag, etc.), there are also numerous methods disclosed herein. For example, methods of dispensing wipes are disclosed herein, as are methods of packaging wipes and methods of supporting wipes. As an example, a method of packaging wipes is disclosed that includes a wall mount with self-sealing cover for use with disposable wipe dispenser bags. Another method of packaging wipes includes a wipe dispenser having a wipe bag and a rigid collar for mounting the bag to a support bracket or mount. The rigid collar defines an enlarged opening and a recessed retainer that forms a recessed well that provides ample space for the next wipe to rest in the retainer without drying out and makes the next wipe easier to be dispensed.

As with the apparatus disclosed herein (e.g., the wall mounted wipes dispensing system, the wall mount support bracket, the disposable wipe dispensing package, etc.), methods focusing on the individual components are also intended to be covered by this disclosure. For example, in addition to a method of dispensing wipes, there is also disclosed a method of packaging wipes comprising: disposing a roll of wipes within a bag defining a single opening; and connecting the single opening of the bag to a rigid collar member to enclose the wipes within the bag and collar member, the rigid collar member defining an opening through which the wipes may be dispensed and having support structures for supporting the bag and wipes.

In addition, there is disclosed herein a method of supporting wipes comprising: providing a wall mounted support structure having a body defining an opening through which wipes may be dispensed, a cover movable between a first position wherein the cover encloses the opening and a second position wherein the cover does not obstruct the opening so that wipes may be dispensed therethrough, and at least one mount centered on the body for mounting the wall mounted support structure to a wall; and mounting the wall mount support structure to a wall via the at least one mount so that wipes may be suspended from the wall mount support structure and dispensed therefrom when the cover is in the second position.

Thus, it is apparent that there has been provided, in accordance with the invention, apparatus, systems and methods for dispensing wipes from a wall mounted wipe dispenser. While the invention has been described in conjunction with specific embodiments thereof, it is evident that many alternatives, modifications, and variations will be apparent to those skilled in the art in light of the foregoing description. While features or functions have been described with respect to one embodiment and perhaps not others, it is understood and intended that features from one embodiment will be combined with features from other embodiments to yield further embodiments. For example, while the above has mainly focused on the use of the dispenser for dispensing wipes, it should also be understood that the dispenser could alternatively be used for other items, such as other wall mounted items that need to be replaced and/or removed and replaced on the wall mount frequently and efficiently. Accordingly, it is intended to embrace all such alternatives, modifications, and variations as fall within the spirit and broad scope of the appended claims.

What is claimed is:

1. A wall mounted wipe dispensing system comprising:

a wall mount support bracket;

a flexible dispensing bag of wipes having a rigid collar from which to suspend the dispensing bag from the wall mount support bracket and having a flexible bag extending from the rigid collar and around the wipes contained therein;

wherein the wall mount support bracket and rigid collar of the dispensing bag have first mating structures for mating the dispensing bag to the wall mount support bracket, and the rigid collar further defines an opening through which wipes are removed from the dispensing bag without having a sealing cap for opening and closing the flexible bag, the rigid collar of the dispensing bag serving as the sole opening on the dispensing bag through which the wipes are removed from the dispensing bag, and the wall mount support bracket includes a sealing cap that is opened to access wipes within the dispensing bag and closed to seal the dispensing bag of wipes to prevent wipes from drying out within same; and wherein the mating structures of the wall mount support bracket and rigid collar of the dispensing bag mate the flexible dispensing bag to the wall mount support bracket via lateral or radial movement of the rigid collar into engagement with the wall mount support bracket.

2. The wall mounted wipe dispensing system of claim 1 wherein the first mating structures include at least one protrusion extending from one of the wall mount support bracket or dispensing bag collar and at least one corresponding mating recess located on the other of the wall mount support bracket or dispensing bag collar for receiving the protrusion to suspend the dispensing bag from the wall mount support bracket.

3. The wall mounted wipe dispensing system of claim 1 wherein the sealing cap includes a biasing member for biasing the sealing cap closed.

4. The wall mounted wipe dispensing system of claim 3 wherein the biasing member is a spring for biasing the sealing cap closed.

5. The wall mounted wipe dispensing system of claim 1 wherein the sealing cap further includes a rubber seal for substantially sealing the dispensing bag when the sealing cap is closed.

6. The wall mounted wipe dispensing system of claim 1 wherein the rigid collar is oriented to suspend the flexible dispensing bag of wipes in a vertical orientation from the wall mount support bracket so that the wipes are removed vertically from the opening of the rigid collar.

7. A method of dispensing wipes from a wall mounted support bracket comprising:

providing a wall mount support bracket with a cover movable between a first, closed position and a second, open position, and a plurality of replaceable dispensing bags of wipes with the support bracket and each replaceable dispensing bag of wipes having first mating structures that mate with one another to suspend one of the replaceable dispensing bag of wipes from the wall mounted support bracket;

suspending one of the replaceable dispensing bags of wipes at a time from the wall mounted support bracket via the first mating structures.

8. The method of claim 7 wherein the wall mounted support bracket and each replaceable dispensing bag of wipes further include second mating structures that mate with one another to confirm when one of the replaceable dispensing bags of wipes is properly aligned with and mounted to the wall mounted support bracket.

9. The method of claim 7 further comprising a seal aligned with the cover, the method further comprising sealing one of the replaceable dispensing bags of wipes when said one of the replaceable dispensing bags of wipes is connected to the wall mounted support bracket to prevent the wipes contained therein from drying out when said one of the replaceable dispensing bags of wipes is mounted to the wall mounted support bracket.

10. The method of claim 7 wherein suspending one of the replaceable dispensing bags of wipes at a time from the wall mounted support bracket via the first mating structures comprises mating the first mating structures of the support bracket and the one of the replaceable dispensing bags of wipes to one another by laterally or radially moving the one of the replaceable dispensing bags of wipes into engagement with the support bracket until the mating structures mate with one another to suspend the one of the replaceable dispensing bags of wipes vertically from the support bracket.

11. The method of claim 10 wherein suspending one of the replaceable dispensing bags of wipes vertically from the support bracket comprises suspending the one of the replaceable dispensing bags of wipes so that individual wipes may be vertically removed in a top dispensing fashion from the one of the replaceable dispensing bags of wipes through the support bracket.

* * * * *